US008100080B2

(12) United States Patent
Bagung et al.

(10) Patent No.: US 8,100,080 B2
(45) Date of Patent: Jan. 24, 2012

(54) MICROWIDTH-ADJUSTABLE SLOT NOZZLE

(75) Inventors: Jorg-Olaf Bagung, Deutsch Evern (DE); Kai Luebbecke, Wittorf (DE)

(73) Assignee: Nordson Corporation, Westlake, OH (US)

( * ) Notice: Subject to any disclaimer, the term of this patent is extended or adjusted under 35 U.S.C. 154(b) by 923 days.

(21) Appl. No.: 12/119,888

(22) Filed: May 13, 2008

(65) Prior Publication Data

US 2008/0282973 A1 Nov. 20, 2008

(30) Foreign Application Priority Data

May 14, 2007 (DE) ..... 20 2007 007 036 U

(51) Int. Cl.
*B05C 5/02* (2006.01)

(52) U.S. Cl. ..... 118/410; 118/411; 118/313; 118/314; 118/315; 222/380; 222/381; 222/482; 222/486; 239/562; 239/563; 156/578

(58) Field of Classification Search ..... 118/313–315, 118/300, 325, 410, 411; 239/562, 563; 427/207.1
See application file for complete search history.

(56) References Cited

U.S. PATENT DOCUMENTS

| | | | | |
|---|---|---|---|---|
| 5,305,955 | A * | 4/1994 | Smitherman et al. | 239/75 |
| 5,894,994 | A * | 4/1999 | Keane et al. | 239/134 |
| 6,689,214 | B2 * | 2/2004 | Burmester et al. | 118/300 |
| 2006/0213434 | A1 * | 9/2006 | Ganzer et al. | 118/300 |
| 2007/0205311 | A1 * | 9/2007 | Stampfli | 239/589 |

FOREIGN PATENT DOCUMENTS

| | | | |
|---|---|---|---|
| DE | 4235736 | C1 | 3/1994 |
| DE | 29908150 | U1 | 9/1999 |
| DE | 29921828 | U1 | 7/2000 |
| DE | 202006014743 | U1 | 11/2006 |
| JP | 2001293414 | A | 10/2001 |
| WO | 2004/065023 | A1 | 8/2004 |

OTHER PUBLICATIONS

German Patent and Trademark Office, Search Report in DE 202007007036.5, Apr. 2, 2009.

* cited by examiner

*Primary Examiner* — Laura Edwards
(74) *Attorney, Agent, or Firm* — Wood, Herron & Evans, L.L.P.

(57) ABSTRACT

Apparatus for applying fluids such as adhesive, in particular hot melt adhesive, to a substrate. The apparatus includes a main body which can be connected to a fluid source, an application valve for selectively interrupting or enabling a flow of fluid, and a nozzle arrangement arranged on the main body for applying the fluid. The nozzle includes a distributor passage communicating with the fluid source, and the nozzle arrangement has at least one outlet opening for delivery of the fluid, which communicates with the distributor passage, and a closure body arranged movably in the distributor passage for varying the length, which can be acted upon with fluid, of the distributor passage. The distributor passage is provided in a one-piece portion of the nozzle arrangement.

11 Claims, 3 Drawing Sheets

MICROWIDTH-ADJUSTABLE SLOT NOZZLE

The present application claims the priority of German Utility Model Application No. 202007007036.5 filed May 14, 2007 under 35 U.S.C. §119. The disclosure of that priority application is hereby fully incorporated by reference herein.

TECHNICAL FIELD

The present invention relates to an apparatus for applying fluids such as adhesive or more specifically, hot melt adhesive, to a substrate.

BACKGROUND

Various types of apparatus are used, for example, when substrates in film or layer form such as labels are to be coated over the surface thereof with liquid adhesive, such as hot melt adhesive. Usually the adhesive is kept in a fluid source which is heatable so that the adhesive can be kept in a fluid condition. That fluid source is connected to a main body of the apparatus by way of a hose connection. The fluid adhesive is conveyed by a conveyor means, such as a gear pump, through suitable bores into the apparatus and further conveyed through a distributor passage in the nozzle arrangement. The nozzle arrangement usually comprises two block portions. On the way to the distributor passage the adhesive passes through a passage portion into which a valve body of an application valve can engage so that the flow can be selectively enabled or interrupted. The distributor passage communicates with a nozzle opening or outlet opening from which the adhesive is applied to a substrate. That outlet opening can be in the form of an elongate slot as is known, for example, from DE 299 08 150. In that case the distributor passage communicates with the outlet opening by way of an elongate uninterrupted opening. The length of the operative portion of the outlet opening is set by a closure body which is arranged movably in the distributor passage.

A disadvantage with such apparatus is that the nozzle arrangements are usually of dimensions which do not allow the apparatus to be used for coating small components. In particular, the use of nozzle arrangements of such dimensions is ruled out when the coating has to be produced within a narrow opening. Such openings are usually to be found in honeycomb plate structures. In particular, sealing the nozzle arrangement, which often consists of two block portions, represents a problem.

Therefore the object of the present invention is to provide an apparatus which at least minimizes the above-mentioned disadvantages and which is suitable in particular for use in spatially constricted environments.

SUMMARY

In an apparatus of the kind defined hereinbefore the invention attains that object in that the distributor passage is provided in a one-piece portion of the nozzle arrangement. In that way the dimensions of the nozzle arrangement can be smaller so that the apparatus can also be used in very tight environments. If the dimensions of the nozzle arrangement are to be reduced, at some time regions are encountered in which the structures usually employed are no longer suited to the purpose of use. The use of a one-piece portion in which the distributor passage is provided makes it possible to obviate that problem. In particular, sealing means of relatively large dimensions are avoided if the distributor passage is provided in a one-piece portion of the nozzle arrangement. Furthermore the use of a one-piece portion has the advantage that the complication and expenditure involved in assembling two filigree block portions is eliminated.

A further advantageous development of the invention is achieved or the foregoing object is attained in accordance with a further aspect of the invention in that the closure body seals off the distributor passage without the use of further sealing elements, in particular the closure body metallically seals off the distributor passage. The term metallic seal is used hereinafter to denote that the closure body directly seals off the distributor passage without the use of further sealing means. A gap seal is formed in which the surfaces which are to be respectively sealed off against each other comprise metal. It will be appreciated however that other materials forming the surfaces to be sealed off are to be interpreted as equivalent to the principle of the invention.

With the dimensions involved here sealing of the distributor passage can no longer be attained by the closure body with usual sealing elements (e.g., rubber O-rings or PTFE sleeves). By virtue of the fact that in accordance with the invention the nozzle arrangement comprises a one-piece portion, on the one hand the problem that the two block portions have to be sealed off relative to each other is eliminated, while on the other hand that structure permits sealing of the distributor passage directly by the closure body without the use of further sealing elements. The use of the one-piece structure for the portion means that the distributor passage can be provided with corresponding tolerances so that it can be sealed off without additional sealing means by the closure body.

A further advantageous development of the invention is achieved or the foregoing object is attained in accordance with a further aspect of the invention in that the closure body is a hollow piston with a female screwthread or the closure body can be moved by means of a hollow piston having a female screwthread and the closure body is steplessly movable in the distributor passage by means of a screwthreaded rod engaging into that female screwthread. It is therefore possible for the entire hollow piston to be provided with the appropriate tolerances which are required for metallic sealing of the distributor body. On the other hand the closure body can adjoin the hollow piston so that the surface area which is required for the metallic sealing action and which is to be provided with the appropriate tolerances can be reduced to a minimum and manufacture can be implemented at lower cost. Usually, there is a displacement device provided for displacement of the closure body. The displacement device is mounted outside the nozzle arrangement and includes a holding device, a screwthreaded spindle and a guide rod (see DE 202006014743U1). Displacement devices of that kind require a great deal of additional structural space. The provision of a female screwthread in the hollow piston and a screwthreaded rod engaging thereinto means that the closure body can be moved within the distributor passage without a large number of components disposed outside the nozzle arrangement being required. This markedly reduces the spatial extent of the nozzle arrangement, thereby further enhancing the suitability of the apparatus according to the invention for use in spatially constricted environments.

An advantageous development of the invention is distinguished in that the outlet opening is formed by means of a recess on at least one of two surfaces of two adjacently arranged components. The provision of recesses on surfaces has advantages from the point of view of production engineering. The present invention is intended to permit the application of fluid in very spatially constricted environments. The nozzle arrangement and, consequently, also the outlet openings must be correspondingly small. In the present case the width of the outlet opening is only a few tenths of a millimeter. If the outlet opening were not formed by two surfaces of two adjacently arranged components, but only one component, then the corresponding surfaces would have to be produced by boring and/or milling machining of the component, in which case the operative portion of the tools used would not be allowed to exceed the desired width of the outlet opening. From the point of view of production engineering it would be very complicated and expensive to produce for example a bore of a diameter of less than 1 mm in a solid metal block. The implementation of the outlet opening according to the invention provides a possible way of producing it in a markedly simpler and less expensive fashion.

In accordance with a preferred embodiment of the invention the outlet opening communicates with the distributor passage by means of bores. As already mentioned hereinbefore it is advantageous from the point of view of production engineering for the outlet opening to be formed by means of a recess on at least one of two surfaces of two adjacently arranged components. It will be noted however that the communication must be afforded between the distributor passage and the outlet opening. From the viewpoint of production engineering it is advantageous for the communication to be produced by means of bores which are interposed between the recesses and the distributor passage. Depending on where the recesses are respectively provided, the bores can extend over a plurality of components and can alter their orientation. The diameter of those bores can be selected within a markedly wider range than the depth of the recesses as the bores do not form the outlet opening and are therefore not subjected to the tight limitations thereof in terms of dimensioning.

An advantageous development of the invention is distinguished in that the longitudinal axes of the bores do not intersect the longitudinal axis of the distributor passage. That means that the position of the bores can be so selected as is desirable for making the communication between the distributor passage and the recesses or the outlet opening.

It is preferred that the outlet opening is formed by at least one slot segment. The term slot segment is used here to denote a volume portion delimited by six flat surfaces which at least in part can be parallel in paired relationship and in which the spacing of one pair of surfaces is markedly less than that of the others. The spacing of the pair of surfaces involving the smallest spacing relative to each other corresponds to the width of the outlet opening. The slot segment can extend parallel to the longitudinal axis of the distributor passage over the entire maximum length of the operative portion of the distributor passage. It is however also possible to provide a plurality of slot segments which extend only over a given fraction of the maximum length of the operative portion of the distributor passage. A continuous or strip-shaped fluid application pattern can be produced in that way.

An advantageous development of the invention provides that the slot segments are formed by recesses on a surface of the plate and/or a surface, which is complementary to said surface, of the one-piece portion. Manufacture of the slot segments is markedly simplified by that arrangement. In particular the fact that they are not in the nozzle arrangement but on one of the surfaces thereof or on a surface of the plate means that they are better accessible for manufacture and it is possible to employ tools whose use is markedly less expensive than would be the case if the elongate slot segments had to be produced directly in the one-piece portion of the nozzle arrangement.

In an advantageous embodiment of the invention the slot segments are of a substantially rectangular cross-section. Rectangular cross-sections are particularly advantageous to manufacture from the production engineering point of view as they can be milled into the corresponding surface of the one-piece portion or the plate, in a single working operation, per slot segment.

An advantageous development of the invention provides that the slot segments are of a substantially trapezoidal cross-section. If the cross-section is so selected that the slot segments are enlarged in a downstream direction, that is to say in the direction of flow of the fluid, the delivered fluid can form a closed application area, when suitable dimensioning is involved, although a multiplicity of discrete slot segments is used. The amount of excess adhesive which runs down in the stopped condition can be reduced in that way, even if the nozzle arrangement is disposed vertically.

Advantageously the screwthreaded rod has an engagement portion for actuation of the screwthreaded rod with an actuating element. In contrast to direct actuation of the screwthreaded rod by hand, the use of an actuating element makes it possible on the one hand to apply greater forces to the screwthreaded rod, while on the other hand actuation can still be implemented even if the screwthreaded rod can only be reached with the hand with difficulty. The actuating element itself can be activated by hand or however by means of a motor.

A preferred embodiment of the invention is distinguished by a support block for fixing the position of the screwthreaded rod, wherein the support block has an opening for partially passing through the support block and for introducing the actuating element into the engagement portion. Fixing the position of the screwthreaded rod ensures that, upon actuation (rotation) of the screwthreaded rod, the hollow piston or the closure body and not the screwthreaded rod is displaced in the distributor passage in the longitudinal direction. To fix the screwthreaded rod but nonetheless to be able to introduce the actuating element into the engagement portion, the support block has a suitable opening.

Advantageously there is provided a clamping portion for preventing the closure body from also rotating upon actuation of the screwthreaded rod. If the closure body or the hollow piston were to also rotate upon actuation of the screwthreaded rod then the rotary movement of the screwthreaded rod could not be converted into a translatory movement of the closure body or the hollow piston. That would be the case for example if the screwthreaded rod jams in the female screwthread of the hollow piston or would not run easily and would then also cause the hollow piston to rotate.

Advantageously the closure body according to the invention has markings, the spacing of which corresponds to the spacing of two adjacent bores. The markings serve as a check that the closure body is in the correct position in the distributor passage. That prevents the closure body only partially covering over a bore, whereby the slot segment communicating with that bore would be subjected to the action of a different volume flow, from the others. That would lead to an uneven application of adhesive and thus unwanted losses in quality of the adhesive join. In addition those markings assist in being able to better determine the position of the piston rod in the distributor passage. Thus the markings can be continuously numbered, whereby it is possible to provide information about the number of bores subject to the action of the fluid and thus the width of the pattern with which the adhesive is applied to the substrate.

In a further preferred embodiment of the invention a filter block is provided on the main body for connection of the fluid source and for passing the fluid into the main body. Using the filter block means that the hose connections do not have to be arranged directly on the main body, whereby the dimensions of the main body can be reduced so that it does not have a disturbing effect on the application of adhesive in spatially restricted environments. On the other hand the filter block can have a plurality of connections for connecting a fluid source, of which that which least interferes with the application of adhesive can be used. In addition there is the possibility of simultaneously connecting a plurality of fluid sources for the same fluid, whereby a continuous supply of fluid can be effected and the application of adhesive does not have to be broken off when the fluid of a fluid source is used up.

The apparatus according to the invention is advantageously developed by a nozzle mounting plate for mounting and fixing the nozzle arrangement on the main body. By means of that nozzle mounting plate, this guarantees that the nozzle arrangement is securely supported over its entire length and torque forces which possibly occur (for example if the nozzle arrangement by mistake knocks against an obstacle) are reliably dissipated whereby the susceptibility to damage of the nozzle arrangement is reduced. That is of significance in particular for the reason that the nozzle arrangement according to the invention is of very small dimensions and therefore has only a low level of flexural strength. It will be noted that minor flexing of the nozzle arrangement could already result in a loss of displaceability of the closure body in the distributor passage, so that the apparatus would no longer be operable.

An advantageous development of the invention provides that the nozzle mounting plate has a bore for the feed of the fluid from the main body to the nozzle arrangement and a bore for receiving a heating cartridge. In that way the nozzle mounting plate is used not only for mounting the nozzle arrangement but at the same time also for feeding the fluid and for receiving the heating cartridge for temperature control of the nozzle arrangement. It is thus possible to dispense with further components and the structural space required for the apparatus can be kept down.

BRIEF DESCRIPTION OF THE DRAWINGS

The invention is described in greater detail hereinafter by way of example by means of the accompanying drawings of a preferred embodiment. In the drawings.

DETAILED DESCRIPTION

Figure 1:
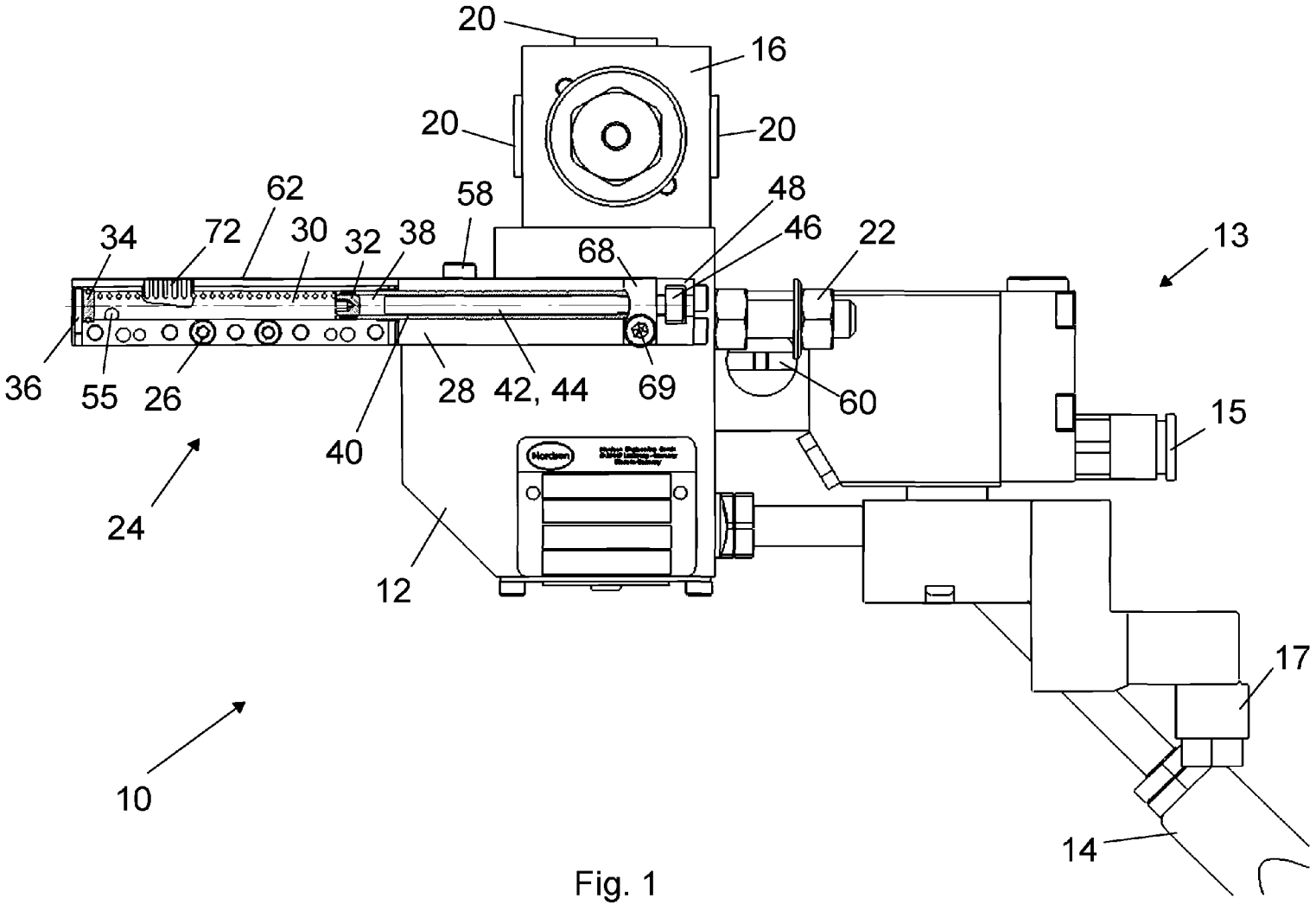
FIG. 1 illustrates a side view of an apparatus according to an embodiment of the invention with a section through the nozzle arrangement.

FIG. 1 shows a possible embodiment of the apparatus 10 according to the invention. Apparatus 10 includes a main body 12, to which an application valve 13 is mounted. The application valve 13 has a compressed air connection 15 and an electrical connection 17. Also provided on the main body 12 is a connecting element 14 for supplying the apparatus 10 with electrical power. Also mounted on the main body 12 is a filter block 16 with a connection option to the fluid source, having a hose connection 18 (see FIG. 2), with which the apparatus 10 can be connected to a fluid source (not shown). The filter block 16 has a plurality of plugs 20 with which bores which are not required for the hose connection 18 are sealed off. Also provided on the main body 12 are holders 22 with which the apparatus 10 can be fixed to support stands, arms or similar elements.

Apparatus 10 further includes a nozzle arrangement 24 including a one-piece portion 28 in which a distributor passage 30 is provided. A closure body in the form of a hollow piston 38 is arranged movably in the distributor passage 30. The distributor passage 30 is sealed off at a first end by a disk 34 with an O-ring, which is fixed by means of a spring pin 36. The closure body (hollow piston) 38, closed with a screwthreaded pin 32, moves in the distributor passage 30, the hollow piston 38 having a female screwthread 40 into which a screwthreaded rod 42 engages. In the illustrated example the screwthreaded rod 42 is in the form of a displacement screw 44. The hollow piston is sealed off at the end by means of a screwthreaded pin 32. The displacement screw 44 has a head 46 embraced by a support block 48 which in turn is fixed to the nozzle arrangement 24.

Figure 2:
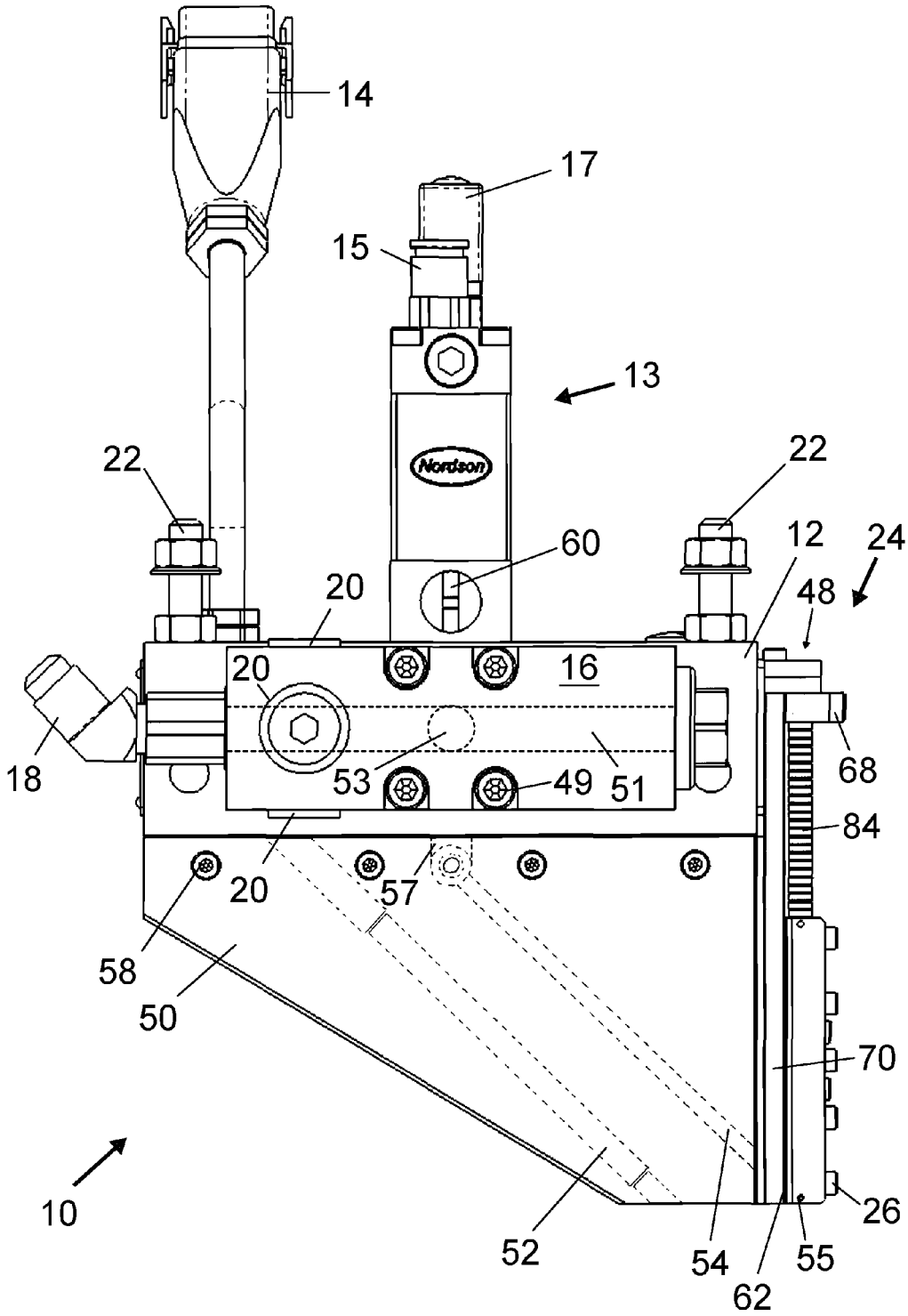
FIG. 2 illustrates a plan view of the apparatus of FIG. 1.

It will be seen from FIG. 2 that the nozzle arrangement 24 is fixed to the main body 12 by way of a nozzle mounting plate 50. The nozzle mounting plate 50 is releasably connected to the main body by connecting means 58 and has two bores 52, 54, the bore 52 serving to receive a heating cartridge (not shown) and the bore 54 serving to supply the nozzle arrangement 24 with fluid. It is also possible to see therefrom the hose connection 18 arranged on the filter block 16.

The flow of fluid through the apparatus 10 is as follows: the hose connection 18 is connected to a fluid source (not shown) from which the fluid is conveyed into the filter block 16 through the hose connection 18 by means of a conveyor device (also not shown). In FIG. 2 the hose connection 18 is fixed to a left end surface of the filter block 16. The filter block 16 has a through bore 51 which in the illustrated example is delimited and sealed off at one end by the hose connection 18 and at the other end by a filter insert 56. At the middle, approximately in the center of four fixing elements 49 with which the filter block 16 is fixed to the main body 12, the filter block 16 has a bore 53 leading to the main body 12. The main body 12 has a bore (not shown) which adjoins same and which opens into a passage 57 extending perpendicularly thereto. A valve needle 60 of the application valve 13 engages into that passage 57 and can thus selectively enable or interrupt the flow of fluid. The passage 57 communicates with the bore 54 in the nozzle mounting plate 50 which opens at an entry opening 55 into the distributor passage 30 (see FIG. 1). The distributor passage 30 communicates with an outlet opening 62 of the nozzle arrangement 24, as is shown in greater detail hereinafter.

The length of the operative portion of the outlet opening 62 is set by the closure body (hollow piston) 38 arranged movably in the distributor passage 30 (see FIG. 1). Therefore, on the one hand the fluid application pattern can be altered by suitable actuation of the application valve 13 and on the other hand the width of the fluid application pattern can be altered by suitable positioning of the closure body 32 in the distributor passage 30, by means of the apparatus 10. To simplify setting the width of the application pattern, the hollow piston 38 is provided with markings 84. The markings help in that respect to determine the position of the hollow piston 38 in the distributor passage 30. For example the markings can be continuously numbered, whereby information can be afforded about the width of the adhesive application pattern on the substrate.

Figures 3A, 3B, 3C:
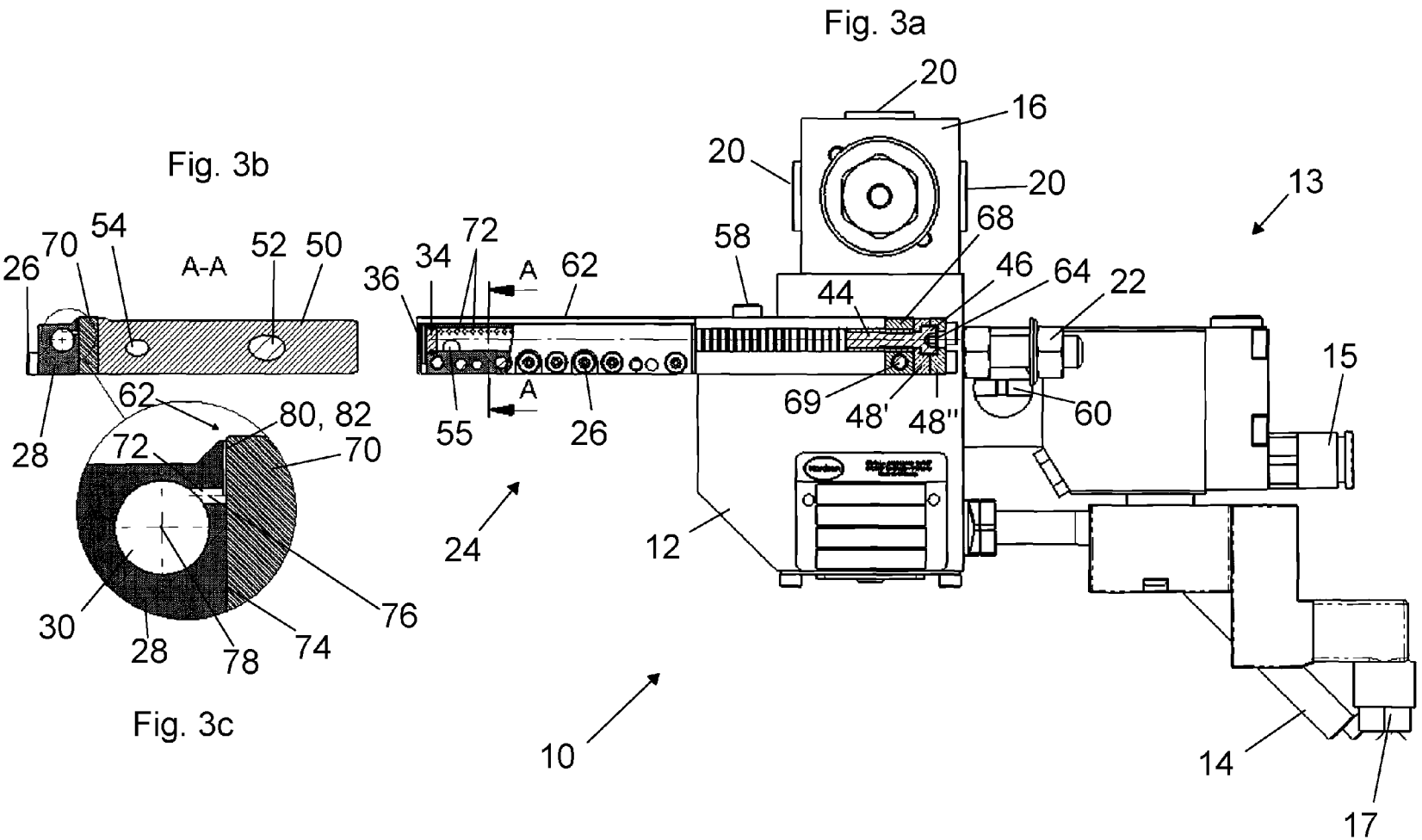
FIG. 3*a* illustrates a side view of the apparatus with an additional longitudinal section through the nozzle arrangement.
FIG. 3*b* illustrates a view in section through the nozzle arrangement along the surface A-A in FIG. 3*a*.
FIG. 3*c* illustrates a portion on an enlarged scale of the sectional view of the nozzle arrangement of FIG. 3*b*.

FIG. 3*a* shows both the displacement screw 44 and also the support block 48 as a sectional view. The support block 48 comprises two block portions 48' and 48" which respectively half embrace the head 46 of the displacement screw 44. The head 46 of the displacement screw 44 has an engagement portion 64 and is of a diameter larger than the shank of the displacement screw 44. The first block portion 48' has a bore, the diameter of which is admittedly larger than the shank diameter but smaller than the diameter of the head 46 of the displacement screw 44. The second block portion 48" also has a bore, the diameter of which is smaller than the diameter of the head 46 but sufficiently large to guide an actuating element (not shown) into the engagement portion 64 of the screw head 46. Such an actuating element could be a screw wrench, in particular a hexagon socket screw key, with which it is also possible to apply relatively high levels of torque for rotating the displacement screw 44. The displacement screw 44 is fixed in its position by means of the support block 48 so that, when the displacement screw 44 is rotated, it is not the displacement screw itself but the closure body 38 that is axially displaced.

There is also provided a clamping portion 68 having a U-shaped recess which embraces the hollow piston 38. The two limbs of the U-shaped recess of the clamping portion 68 are braced to each other by a screw 69 so that the clamping portion is connected to the hollow piston in frictionally locking relationship. The clamping portion 68 is of a substantially rectangular cross-section and bears with an end face against a face of an adjacent component so that the clamping portion 68 cannot rotate. The clamping portion 68 prevents a rotary movement of the hollow piston 38 but allows a translatory movement thereof. Preventing a rotary movement of the hollow piston 38 is important for the reason that otherwise the rotary movement of the displacement screw 44 could not be converted into a translatory movement of the hollow piston 38. Such situations could arise for example if the male screwthread of the displacement screw 44 and the female screwthread 40 of the hollow piston 38 have damage which would prevent the one component being able to rotate freely about the other. The same situation could also occur due to corrosion of the two screwthreads or due to the ingress of dirt into the screwthread flights.

The selected manner of displacement of the closure body 38 in the distributor passage 30 has the advantage that the components required for that purpose (essentially the support block 48, the clamping portion 68 and the displacement screw 44) do not require much structural space (see in that respect the displacement device disclosed in DE 202006014743U1) so that use of the apparatus 10 even in spatially constricted environments is not adversely affected by a displacement device which projects far beyond the nozzle arrangement 24.

FIG. 3*b* shows a section along the surface A-A defined in FIG. 3*a*. Therein it is possible to see on the one hand the nozzle mounting plate 50 with the bores 52 and 54 for a heating cartridge and the feed of fluid to the distributor passage 30, and on the other hand the structure of the outlet opening 62. A plate 70 is disposed between the nozzle mounting plate 50 and the one-piece portion 28. The one-piece portion 28 and the plate 70 are fixed to the nozzle mounting plate 50 by way of fixing elements 26.

As can be seen in particularly from FIG. 3*c* the one-piece portion 28 has a multiplicity of bores 72 (see FIG. 1) leading from a surface 74 which is adjoined by the plate 70 to the distributor passage 30. The bores 72 have longitudinal axes 76 which in the illustrated example do not intersect a longitudinal axis 78 of the distributor passage 30. On the surface 74 the one-piece portion 28 has a recess 80 which extends from the bore 72 to the outlet opening 62. Together with the plate 70 the recess 80 forms a slot segment 82 which communicates by means of the bores 72 with the distributor passage 30, by way of which the fluid passes to the outlet opening 62 and is delivered from there. The recess 80 can be formed either on the surface 74 of the one-piece portion 28 but it can also be disposed on the surface of the plate 70 which is in opposite relationship to the surface 74, or on both surfaces. Furthermore the recess 80 can extend over the entire length of the part, which can be acted upon with fluid, of the distributor passage 30, without interruption, or can be subdivided into individual portions so that a multiplicity of slot segments 82 is formed.

It would also be conceivable for the recess 80 to be caused to communicate directly with the distributor passage 30. That would be disadvantageous however from many different aspects. If the slot should extend over the entire nozzle arrangement 24, the one-piece portion 28 would be weakened so that dilation of the distributor passage 30 could occur, which would have the result that the closure body 32 could no longer securely seal off the distributor passage 30.

Depending on the respective use involved, it may be necessary for the recesses 80 to be formed of a depth of less than 1 mm. If the recesses 80 were to open directly into the distributor passage 30 (without the interposition of the bores 72), a kind of slot of a corresponding width of less than 1 mm would have to be produced. That would be extremely complicated and expensive in terms of production engineering, in particular if it is not just an uninterrupted slot but a plurality of slots that are required to be able to produce corresponding slotted segments.

The solution proposed has the advantage that the surfaces of the plate 70 or the surface 74 of the one-piece portion 28 on which the recesses 80 are arranged are freely accessible and therefore simple to machine. Production of the recesses 80 is therefore markedly more advantageous, in comparison with the above-described method.

Forming the distributor passage 30 in the one-piece portion 28 of the nozzle arrangement 24 permits metallic sealing of the distributor passage 30 by the closure body 32, that is to say without the use of additional sealing means such as for example O-rings or plastic sleeves, for example of PTFE. Particularly if the closure body 32 and the distributor passage 30 are to be of small dimensions, affording sealing integrity is problematical as on the one hand installation is difficult and on the other hand sealing means which correspond to those dimensions are not commercially usually available and would therefore have to be the subject of special manufacture. Depending on the respective implementation the diameter of the distributor passage 30 is for example 6 mm and the height of the nozzle arrangement 24 is 14 mm. Forming the distributor passage 30 in a one-piece portion further has the advantage that the peripheral surfaces of the distributor passage 30 and the closure body 32 can be provided with tolerances which permit reliable metallic sealing of the distributor passage 30 by the closure body 32. In an embodiment of the distributor passage 30 in a portion comprising two halves, as is usually employed in the state of the art, the peripheral surfaces could admittedly also be produced with suitable tolerances which permit metallic sealing. It will be noted however that the two halves of the portion would have to be very exactly connected together. If the two halves were fixed together with screws, they would have to be tightened neither too firmly nor too loosely. In the former case that would no longer guarantee axial displaceability of the closure body 32 in the distributor passage 30, while in the latter case the closure body 32 could no longer seal off the distributor passage 30.

The scope of protection of the present invention is not restricted to the embodiment by way of example used for explanation purposes. Other solutions in which for example the communication between the outlet opening and the distributor passage is implemented in ways other than those described herein are not a departure from the inventive idea of the present invention and thus from the claimed scope of protection. Instead of using bores it would for example be possible to design the recesses in such a way that they communicate directly with the distributor passage. Embodying the distributor passage in a two-part or multi-part portion of the nozzle arrangement also does not involve a departure from the scope of protection. In addition the screwthreaded rod could be actuated by means of a motor so that the use of an actuating element which is to be operated manually becomes redundant. Displacement of the closure body can also be implemented with the displacement device known from the state of the art (see DE202006014743U1). Sealing of the distributor passage by the closure body, other than metallic sealing, is also embraced by the scope of protection.

While the present invention has been illustrated by a description of various embodiments and while these embodiments have been described in some detail, it is not the intention of the Applicant to restrict or in any way limit the scope of the appended claims to such detail. Additional advantages and modifications will readily appear to those skilled in the art. The various features disclosed herein may be used alone or in any combination depending on the needs and preferences of the user. The scope of the invention itself should only be defined by the appended claims.

What is claimed is:

1. A dispensing apparatus for applying hot melt adhesive to a substrate, comprising:

a main body configured to be coupled to an adhesive source;

a nozzle arrangement coupled to the main body, the nozzle arrangement including a one-piece nozzle portion, a distributor passage located in the one-piece nozzle portion and communicating with the main body to receive hot melt adhesive from the adhesive source, at least one outlet slot defined at least partially by the one-piece nozzle portion, and a plurality of bores located in the one-piece nozzle portion and providing communication between the distributor passage and the at least one outlet slot;

an application valve coupled to the main body for selectively interrupting or enabling flow of hot melt adhesive from the main body into the distributor passage; and a closure body movably arranged in the distributor passage and operable to vary a length of the distributor passage.

2. The dispensing apparatus of claim 1, wherein the closure body includes a piston, and the piston and the one-piece nozzle portion are each composed of metal and sized such that the piston and the distributor passage produce a metallic seal with one another.

3. The dispensing apparatus of claim 1, wherein the distributor passage has a first longitudinal axis and each of the plurality of bores has a second longitudinal axis, wherein none of second longitudinal axes intersect the first longitudinal axis.

4. The dispensing apparatus of claim 1, further comprising:

a nozzle mounting plate adapted to couple the nozzle arrangement to the main body, the nozzle mounting plate including a fluid bore providing fluid communication between the main body and the distributor passage and a second bore adapted to receive a heater cartridge.

5. The dispensing apparatus of claim 4, wherein the nozzle mounting plate and the one-piece nozzle portion are coupled to each other at corresponding abutment surfaces, and the at least one outlet slot is defined by a recess formed in one or both of the abutment surfaces.

6. The dispensing apparatus of claim 5, wherein the at least one outlet slot defines a substantially rectangular cross-section.

7. The dispensing apparatus of claim 5, wherein the at least one outlet slot defines a substantially trapezoidal cross-section.

8. The dispensing apparatus of claim 1, wherein the closure body includes a hollow piston including a female screwthread, and the dispensing apparatus further comprises:

an actuator including a screwthreaded rod engaged with the female screwthread of the hollow piston, the screwthreaded rod adapted to drive movement of the closure body within the distributor passage.

9. The dispensing apparatus of claim 8, wherein the screwthreaded rod includes a head portion adapted to be driven to rotate the screwthreaded rod, and the main body further includes a support block engaging the head portion of the screwthreaded rod so as to prevent translational movements of the screwthreaded rod and to allow rotational movements of the screwthreaded rod.

10. The dispensing apparatus of claim 9, wherein the main body further includes a clamping portion located adjacent to the support block, the clamping portion frictionally engaging the hollow piston so as to prevent rotational movements of the hollow piston and to allow translational movements of the hollow piston, thereby ensuring that rotational movement of the screwthreaded rod is converted to translational movement of the hollow piston.

11. The dispensing apparatus of claim 8, wherein each of the plurality of bores is spaced apart by a spacing distance, and the hollow piston includes external markings spaced apart by the spacing distance so that the number of bores in fluid communication with the distributor passage may be visually indicated by the external markings.

* * * * *